US007364555B1

(12) United States Patent
Davidson

(10) Patent No.: US 7,364,555 B1
(45) Date of Patent: Apr. 29, 2008

(54) SELF-ASSISTED SHOULDER PASSIVE RANGE OF MOTION APPARATUS

(76) Inventor: John Davidson, 6206 Warbler La., Bradenton, FL (US) 34202

( * ) Notice: Subject to any disclaimer, the term of this patent is extended or adjusted under 35 U.S.C. 154(b) by 574 days.

(21) Appl. No.: 11/141,821

(22) Filed: Jun. 1, 2005

Related U.S. Application Data

(63) Continuation of application No. 60/593,055, filed on Dec. 3, 2004.

(51) Int. Cl.
*A61H 1/02* (2006.01)
*A63B 23/12* (2006.01)

(52) U.S. Cl. ..... 601/33; 482/131; 482/139; 482/904; 482/907

(58) Field of Classification Search ..... 482/44, 482/49, 79, 91–95, 131, 139, 904, 907; 601/23, 601/33, 40; 602/4, 20, 32, 34, 35
See application file for complete search history.

(56) References Cited

U.S. PATENT DOCUMENTS

| | | | | | |
|---|---|---|---|---|---|
| 339,160 | A | * | 4/1886 | Galt | 602/4 |
| 1,121,795 | A | * | 12/1914 | Burton | 602/4 |
| 2,274,574 | A | * | 2/1942 | Zerne | 482/129 |
| 2,716,027 | A | * | 8/1955 | Gehri | 482/131 |
| 3,089,700 | A | * | 5/1963 | Hotas | 482/94 |
| 3,814,084 | A | * | 6/1974 | Gustafson | 482/131 |
| 3,892,230 | A | | 7/1975 | Baker et al. | |
| 5,031,605 | A | * | 7/1991 | Mills | 602/36 |
| 5,048,825 | A | | 9/1991 | Kelly | |
| 5,179,939 | A | | 1/1993 | Donovan et al. | |
| 5,433,688 | A | * | 7/1995 | Davies | 482/124 |
| 5,501,656 | A | | 3/1996 | Homma et al. | |
| 5,520,615 | A | | 5/1996 | Fontana et al. | |
| 5,632,726 | A | | 5/1997 | Repice et al. | |
| 5,807,214 | A | * | 9/1998 | Riazi | 482/129 |
| 5,913,749 | A | | 6/1999 | Harmon | |
| 6,530,868 | B1 | | 3/2003 | Pape | |
| 6,705,974 | B1 | | 3/2004 | Tardif | |

* cited by examiner

*Primary Examiner*—LoAn H. Thanh
*Assistant Examiner*—Victor K. Hwang
(74) *Attorney, Agent, or Firm*—Charles J. Prescott

(57) ABSTRACT

A self-assisted shoulder passive range of motion (SA-PROM) apparatus. The apparatus includes a forearm support adapted to receive the forearm of the affected arm, a double pulley assembly, a single pulley connectable to an elevated support such as an upper door edge, and a main support rope, one end of which is attached to the double pulley, the other end having an enlarged handle. A central portion of the main support rope is engagable over the single pulley. A secondary rope arrangement which is preferably formed of a single length of rope, is attached to each of a plurality of holes formed through said forearm support in proximity to each end and each side margin of the forearm support and arranged over the secondary pulleys to self-regulate pitch and roll movement of the forearm support. The affected arm may be passively raised and lowered through a range of motion by pulling on the handle with the unaffected arm.

14 Claims, 4 Drawing Sheets

SELF-ASSISTED SHOULDER PASSIVE RANGE OF MOTION APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to therapeutic and rehabilitative apparatus for stretching and exercising a shoulder, and more particularly to an apparatus which self-assistedly provides shoulder passive range of motion therapy for a user or patient.

2. Description of Related Art

There are several methods of accomplishing therapeutic range of motion associated with rehabilitation of an injured or recent surgery of a shoulder area of a patient. Active range of motion (AROM) is utilized by a patient who is able to move under his or her own power without assistance. Assisted active range of motion (A-AROM) is utilized by a patient utilizing his or her own body weight to augment the range of motion therapy. Passive range of motion (PROM) is motion provided for the patient by a therapist or attendant. Lastly, Continuous passive range of motion (C-PROM) is associated with providing a device which implements PROM for a preset amount of time.

PROM is typically prescribed as an initial mode of therapeutic intervention for patients who experience a range of motion limitation or otherwise require passive range of motion to regain functionality. The only home exercise available is the Codman's exercise in which the patient bends at the waist and allows the affected upper extremity to passively hang down. The patient then noves his body to passively swing the arm.

In the clinic, PROM has been performed in one of two ways, either by a therapist or through the use of a standard pulley system. PROM performed by a therapist is considered to be the "gold standard" or the very best form of range of motion therapy, but is not optimal for at least two reasons. First, the therapist can only perform this therapy on a limited time basis, typically one hour per session and perhaps only a few times a week for a limited time period due to insurance reimbursement limitations. Moreover, due to patient anxiety, full relaxation may not be possible during PROM. The automatic self-preserving guarding or hesitation can cause increased pain and potential damage to recovering tissue.

The use of PROM by a standard pulley system is somewhat controversial. Some physicians and therapists believe that PROM can be performed utilizing standard pulley systems although there is a lack of evidence to support that position. In fact, PROM by standard pulley system implementation averages 17.6% of the maximum muscular activity as compared to 5% from therapist-assisted PROM.[1] With a standard pulley system, the patient grasps the handle of the pulley once this occurs, muscles of the hand, wrist, forearm and the shoulder are facilitated.

[1] Dockery, M I, Wright, T W, and Lastayo, P., Electromygrophy of the shoulder, an analysis of passive modes of exercise. Orthopedics 11:1181, 1998

A number of patented prior art devices attempt to provide some level of additional passive or active range of motion but fail to disclose the full benefits achieved by the present invention. Those references are summarized herebelow:

U.S. Pat. No. 3,892,230 to Baker, et al. teaches an orthopedic device for loosening a stiffened shoulder joint. The non-portable device uses a sling for holding the mark which is not locked in place and could be unsafe for use by a postoperative patent. A portable doorway and floor stand exerciser for use by wheelchair occupants is taught by Kelly in U.S. Pat. No. 5,048,825. The device is primarily used to develop strength and not for increasing range of motion of the shoulder.

Donovan, et al. discloses a passive anatomic shoulder exerciser in U.S. Pat. No. 5,179,939 and, while providing PROM, would require an attendant and electrical power. U.S. Pat. No. 5,501,656 to Homma, et al. teaches an arm motion support apparatus which is not designed to increase range of motion but to decrease gravity of the affected area allowing the patient to gain freedom of motion.

Fontanna, et al. teaches a shoulder stretching and rotation machine in U.S. Pat. No. 5,520,615 wherein physical therapy of the shoulder joint through passive internal and external rotation of the shoulder is provided. A device for use on a traction machine to treat carpal tunnel syndrome is taught by Repice, et. al. in U.S. Pat. No. 5,632,726. Harmon teaches a resistance exercise apparatus in U.S. Pat. No. 5,913,749; however, this device does not provide PROM and is not a pulley system. Pape teaches a non-passive resistance exercising apparatus in U.S. Pat. No. 6,530,868 and U.S. Pat. No. 6,705,974 to Tardif teaches a device developed for active assistive stretching of the lower extremities and could not safely perform PROM.

The present invention is associated with the newest range of motion form, i.e. self-assistive passive range of motion (SA-PROM) wherein a device is used to help the patient independently perform true PROM. The present invention is the only apparatus known to accomplish the SA-PROM form of shoulder therapy.

The present invention provides an apparatus which enables a patient to perform safe, self-assisted passive range of motion (SA-PROM) either in a clinic or at home after proper educational use of the apparatus. Thus, the patient may safely perform SA-PROM which will typically greatly increase the frequency and time or duration of therapy and thus improve the overall outcome while decreasing discomfort for the patient. In use, the present system includes an attachment preferably to the top edge of a door; the patient rests the affected forearm in an elongated forearm support which is secured in place preferably by releasable straps. The forearm support enables the elbow to be straight, decreasing the patient's ability to use the bicep to help facilitate motion. The patient then pulls down on a handle connected at one end of an elongated main rope with the unaffected arm. Slow, gentle steady movement of the affected arm by controlled motion of the handle is thus achievable while also reducing the level of discomfort experienced by the patient.

BRIEF SUMMARY OF THE INVENTION

This invention is directed to a self-assisted shoulder passive range of motion (SA-PROM) apparatus. The apparatus includes a forearm support adapted to receive the forearm of the affected arm, a double pulley assembly having two spaced pulleys and an attaching hook or ring, a single pulley connectable to an elevated support such as an upper door edge, and a main support rope, one end of which is attached to the double pulley. The other end of the main rope has an enlarged handle attached thereto, a central portion of the main support rope engagable over the elevated single pulley. A secondary rope arrangement which is preferably formed of a single length of rope, is attached to each of a plurality of holes formed through the forearm support in proximity to each end and adjacent each side margin of the forearm support and arranged over the secondary pulleys to self-regulate pitch and roll movement of the forearm support to minimize shoulder stress. The affected arm may be passively raised and lowered through a range of motion by pulling on the handle with the unaffected arm.

It is therefore an object of this invention to provide a self-assisted shoulder passive range of motion (SA-PROM) apparatus.

Yet another object of this invention to provide a shoulder passive range of motion apparatus which may be utilized without assistance by a patient requiring stretching and rehabilitation of an injured or recent surgery shoulder.

Still another object of this invention is to provide an SA-PROM which effectively reduces shoulder stress and patient anxiety and thusly reduces the possibility of further injury to an affected shoulder.

Yet another object of this invention is to provide an SA-PROM apparatus which quickly balances the anterior aspect of pitch movement during range of motion movement of the affected arm.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
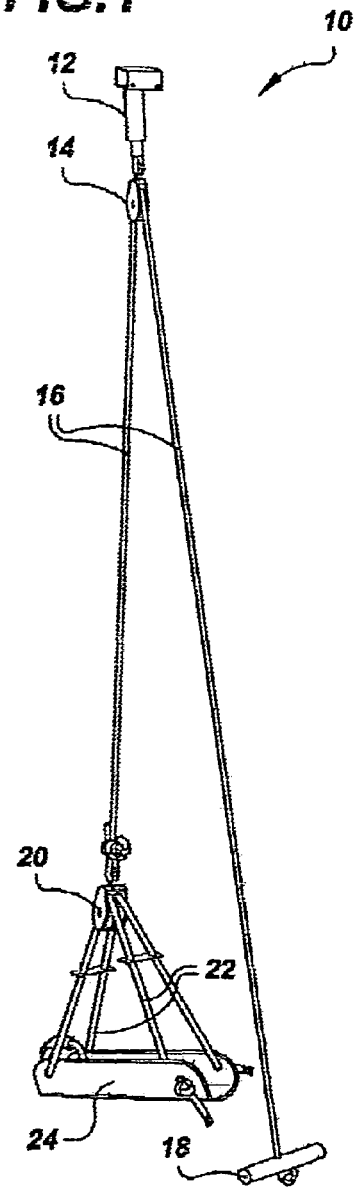
FIG. 1 is a perspective view of one embodiment of the invention.
Figure 2:
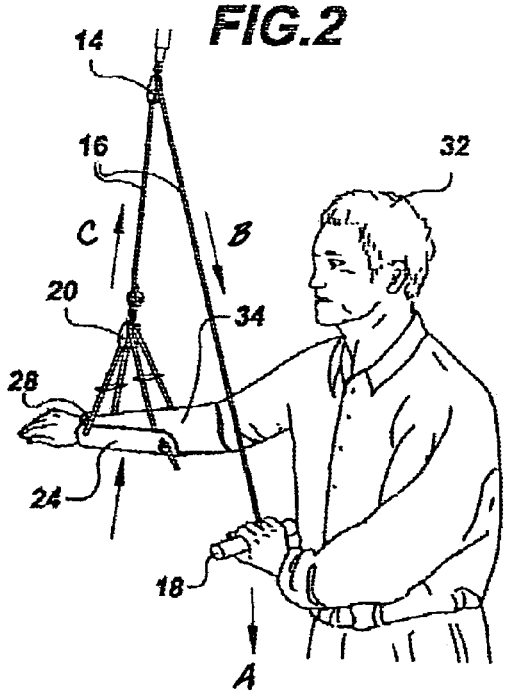
FIG. 2 is a perspective view of the invention of FIG. 1 in use.
Figure 3:
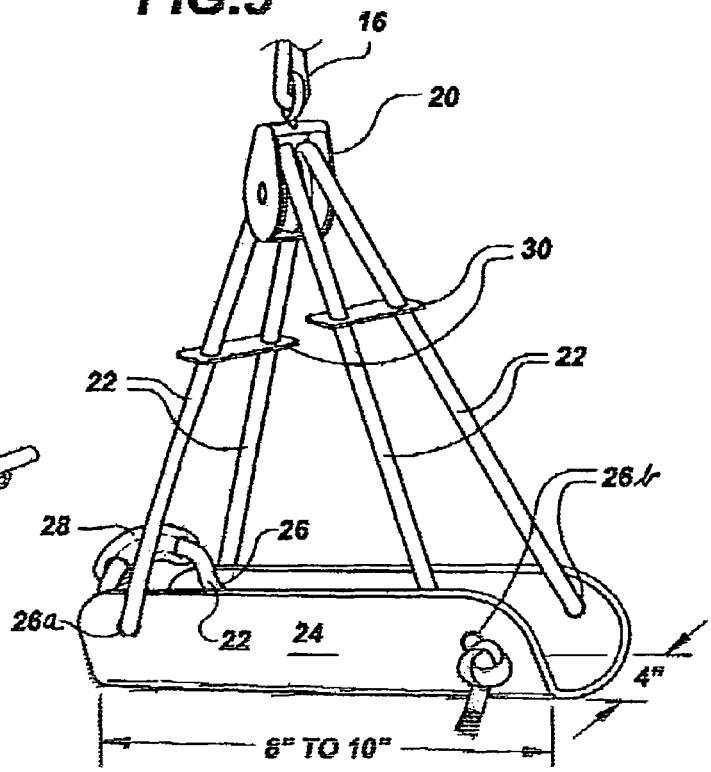
FIG. 3 is an enlarged perspective view of the forearm support and secondary rope segments interengaged with the double pulley assembly of FIG. 1.

Referring now to the Figures and particularly to FIGS. 1 to 3, one embodiment of the invention is there shown generally at numeral 10 and includes an attaching bracket 12 which is supportively engageable onto the upper margin of a door (not shown in these figures) which supports a standard single pulley 14 and rollably receives and supports a main rope 16 having a handle 18 attached to the distal end thereof. Note that any elevated supportive attachment to an alternate overhead structure would be equivalent to a door.

A double pulley assembly 20 includes an upper eyelet which is attachable to the proximal end of the main rope 16 as best seen in FIG. 3. This double pulley 20 includes two side-by-side coaxially mounted pulleys each independently rotatable.

An elongated contoured forearm support 24 is adapted to supportively receive and cradle the forearm 34 of the affected arm, e.g., the right arm as shown in FIG. 2. A secondary rope arrangement includes a plurality of secondary rope segments 22 which support the forearm support 24 by engagement with the double pulley assembly 20. Each end of the secondary rope system 22 is fed through a hole formed adjacent the wrist or forwardly end of the forearm support 24 at 26 and securely knotted in place as shown in FIG. 3. The rope segments 22 are fed over the double pulley assembly 20 and a mid portion of the secondary rope assembly 22 is slidably engaged through transversely opposing holes 26*a* on either side of and adjacent to the forward or wrist end of the forearm support 24.

A length of soft compressible foam tubular sleeve 28 is slidably engaged over the secondary rope 22 as seen in FIG. 3 to secure the forearm at the wrist area to the forearm support 24 between holes 26*b*. As supportive tension is applied to the main rope 16 in the direction of arrow C when pulled downwardly in the direction of arrow B by handle 18 by the unaffected arm of the user 32, the sleeve 28 is pliantly engaged around the wrist area. As lifting of the forearm support 24 occurs upwardly in the direction of the arrow in FIG. 2, the affected arm of the user is lifted and supported as shown. Plastic spacers 30 are slidably attached between two of the secondary rope segments 22 to help maintain alignment of the rope segments 22 until full supportive lifting force is exerted to fully support the affected arm positioned within the forearm support 24.

Figure 6:
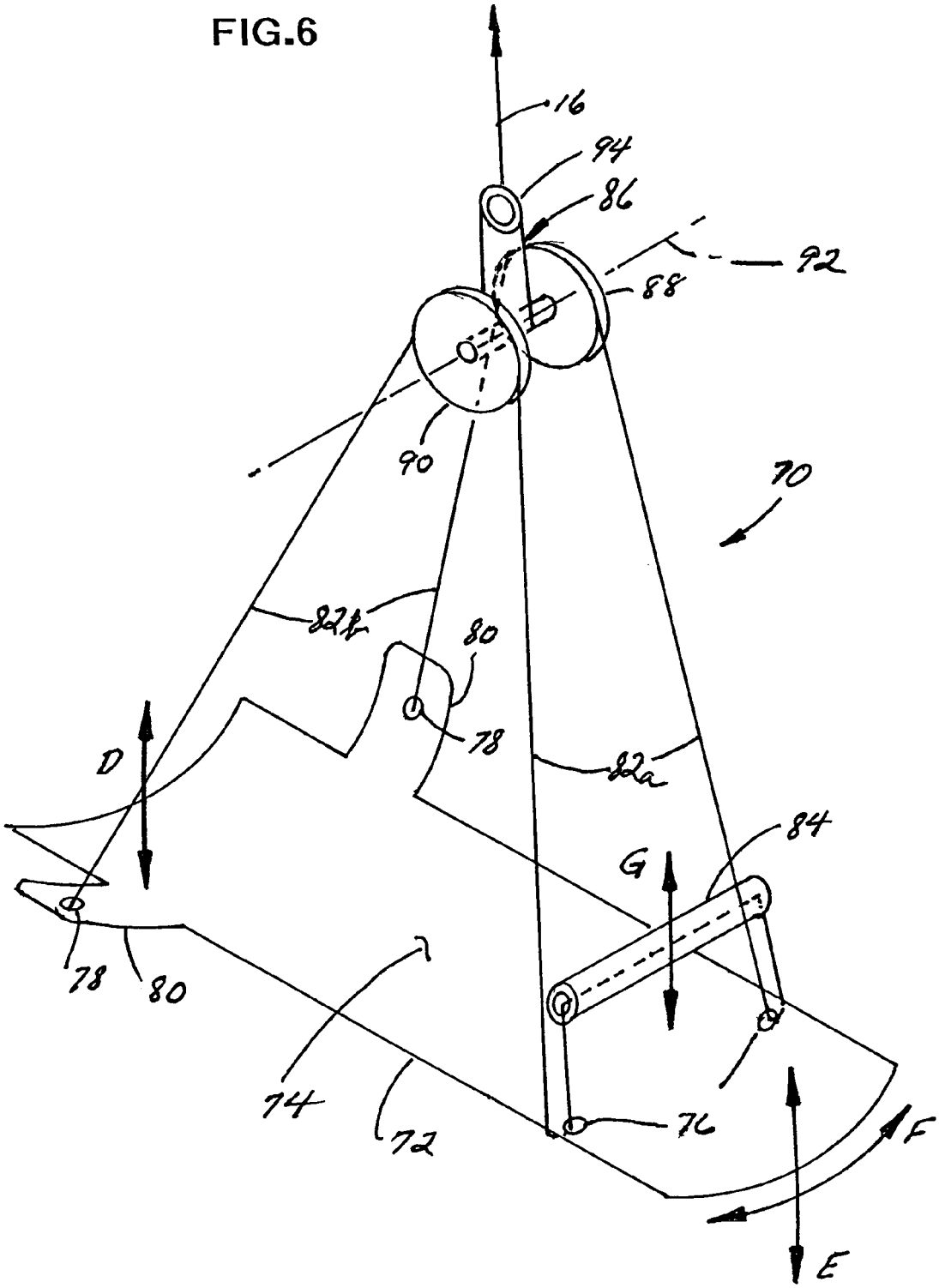
FIG. 6 is a simplified or schematic perspective view of the forearm support and secondary rope arrangement absent restraining straps for simplicity.

Referring now to FIG. 6, a simplified schematic view of the operation of the secondary rope system connected between the double pulley assembly 86 and the forearm support 72 is there shown at numeral 70. The forearm support 72, having an elongated generally concave surface 74 adapted to comfortably cradle the affected forearm, also includes ears or tabs 80 to further stabilize and support the forearm near the elbow and also to outwardly position transversely opposing holes 78 which are typically positioned along side of the larger portion of the forearm adjacent the elbow. Transversely opposing holes 76 are positioned adjacent the wrist area of the affected arm in proximity to both the side margins and the forwardly end margin of the forearm support 72.

The double pulley assembly 86, having spaced coaxially mounted independently freely rotatable pulleys 88 and 90, is supported by a bracket or hook 94 thereof attachable to the proximal end of main rope 16 as previously described. The secondary rope segments 82*a* and 82*b*, formed of a single length of rope, are arranged specifically to facilitate the quick and relatively stress free orientation of the forearm as the lifting force is exerted via the main rope 16 by the unaffected arm of the user. This is accomplished by feeding the two rear secondary rope segments 82*b*, which are anchored by knotting at opposing holes 78, up and over the corresponding pulleys 90 and 88, respectively. The front or forwardly secondary rope segments 82*a* extend downwardly from the pulleys 88 and 90 downwardly to the corresponding opposing holes 76 and upwardly fed therethrough and passing through a flexible resilient tubular sleeve 84 as shown.

By this arrangement, as the weight of the affected forearm positioned and secured in place atop concave surface 74 with the wrist positioned beneath the flexible sleeve 84, a balancing effort is accomplished to quickly stabilize the affected forearm without inducing substantial hurtful stress to the shoulder of the affected arm. Thus, pitch movement in the direction of arrows D and E of the forearm support 72 is quickly equalized as the flexing movement of the sleeve 84 in the direction of arrow G is accomplished to pliantly restrain the wrist area. Further, any rolling motion in the direction of arrow F which might induce painful stress to the shoulder is also minimized as the double pulley assembly 86 effectively neutralizes and balances forces through the secondary line segments 82*a* and 82*b* as the forearm is lifted.

In operation, the forearm support remains flush or in complete contact with the forearm of the patient's affected arm throughout elevation and depression thus providing true passive range of motion (PROM) for a post surgical shoulder or a frozen shoulder. This passive range of motion is shown to prevent facilitation of shoulder muscles to contract because activation of the distal muscles is eliminated due to the complete relaxation of the affected arm while the unaffected arm controls the passive range of motion movement. The present invention thus enables the patient to passively move the gleno-humeral joint through three different planes of motion, shoulder flexion, scaption, and abduction. By providing the firm resting forearm support, the user will automatically decrease muscle guarding which eliminates activation of the hand, wrist, elbow or shoulder muscles of the affected arm. By providing a secondary rope system which balances the forces of lifting the forearm quickly and evenly, the risk of nerve compression at the wrist is substantially decreased if not virtually eliminated.

Figure 4:
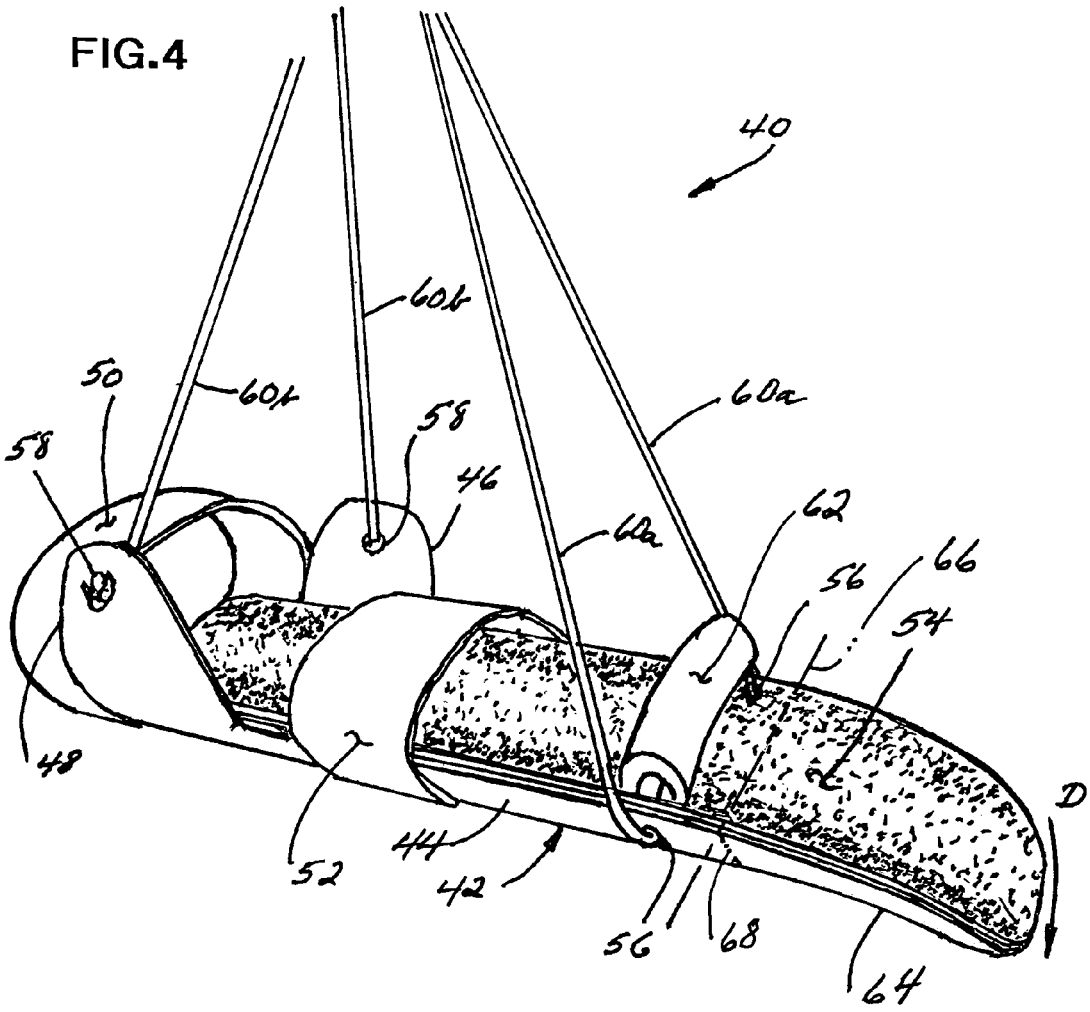
FIG. 4 is a perspective view of another preferred embodiment of the invention.
Figure 5:
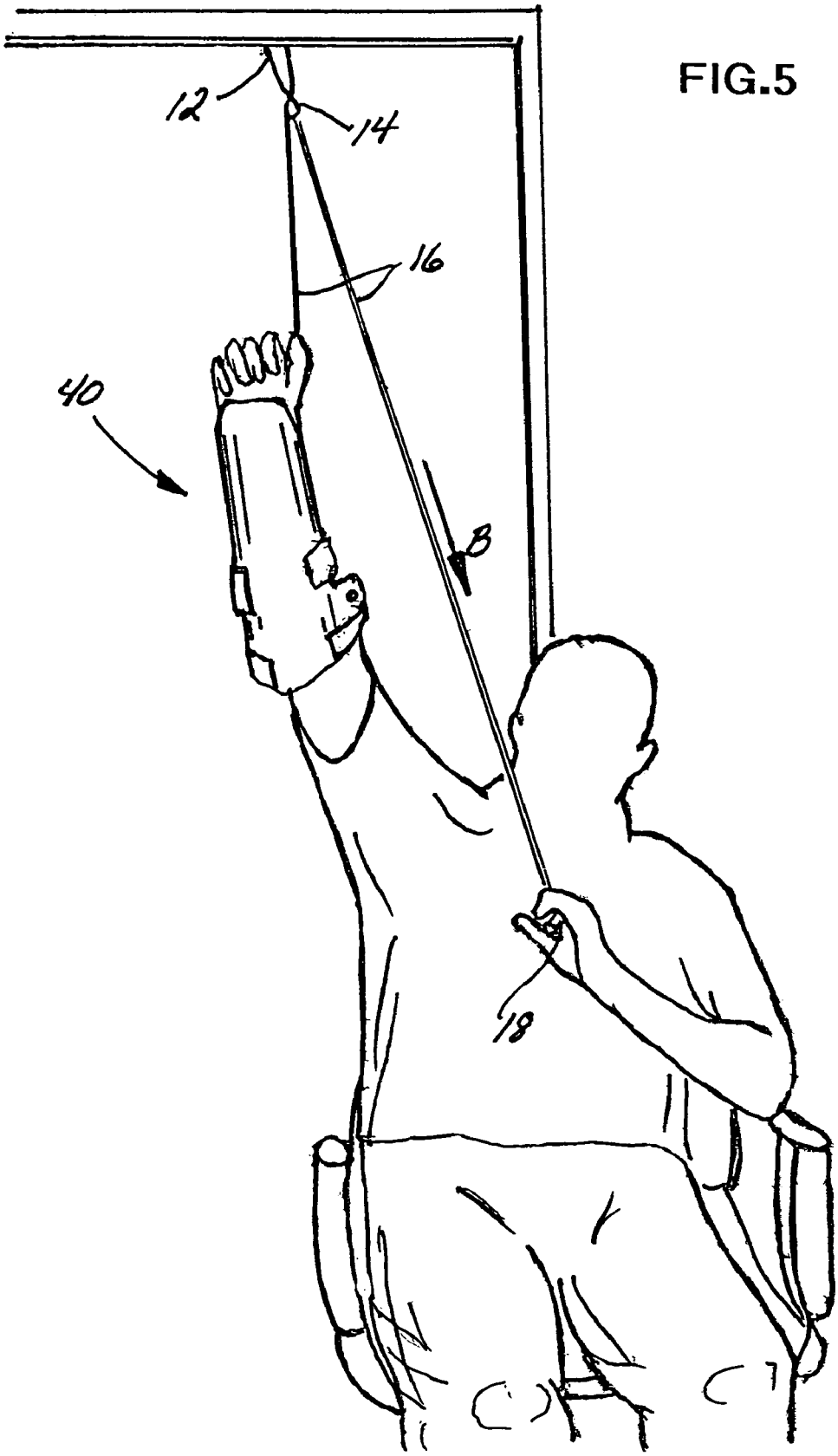
FIG. 5 is a perspective view of the invention of FIG. 4 in use.

Referring now to FIGS. 4 and 5, another and preferred embodiment of the invention is there shown generally at numeral 40 and includes a forearm support 42 and a secondary rope arrangement, the segments of which are shown at 60*a* and 60*b* formed of a single continuous length of rope. The forearm support 42 is formed of a thin semi-rigid or rigid plastic material into a concaved elongated shell 44 having diagonally outwardly extending tabs 46 and 48 having holes 58 opposingly formed therethrough. Adjacent the forwardly or wrist end of the forearm support 42, opposing holes 56 are formed adjacent to the side margins thereof.

As previously described, the secondary rope segments 60*a* and 60*b* are attached to the forearm support through holes 56 and 58, respectively. The distal ends of the secondary rope arrangement are anchored by knotting into or at holes 58 adjacent the elbow, while the central portion of the secondary rope arrangement is slidably engaged through the opposing holes 56 and threadably engaged through a flexible elongated resilient tubular sleeve 62 to comfortably press around and hold the wrist of the affected arm against the padded concaved surface 54 formed of compressible sheet foam material for added comfort.

The forearm is restrained in this embodiment 40 by VELCRO-attached forearm bands 50 and 52 which matably engage over the forearm in a lightly tightenable fashion to further stabilize the forearm from any lifting or displacement movement with respect to the padded concaved surface 54 of the forearm support 42. Flexure of the wrist-supporting portion 64 about a transverse bending line 66 is accomplished by either a split or a line of flexure 68. Other arrangements of overlapping components in this region 68 may be provided, the net result of which is that any flexure motion of the wrist during the PROM to be relieved of any possible distress imposed by a restraint of the wrist of the affected arm, particularly found useful when the arm is in the elevated position as seen in FIG. 5.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A self-assisted shoulder passive range of motion apparatus comprising:

an elongated contoured forearm support adapted to receive the forearm of the affected arm and extending generally between the elbow and wrist of the user;

a double pulley assembly having two spaced pulleys and an attaching hook or ring;

a single pulley connectable for support to an elevated support such as a ceiling, upper door edge and an upper wall;

a main support rope, one end of which is attached to the attaching hook or ring of said double pulley, the other end of said main support rope having a hand grasping member, a central portion of said main support rope engagable over said single pulley for free rolling movement thereover;

a group of secondary rope segments each attached at a lower end thereof to one of a plurality of holes formed through said forearm support in proximity to each end of each side margin of said forearm support;

an upper portion of each of said rope segments passing over one or the other of said pulleys and arranged to regulate pitch and roll movement of said forearm support;

wherein said group of rope segments are substantially continuous for enhanced automatic positional adjustment of said forearm support when tension is applied to said main rope; and a restraining sleeve positioned transversely between two opposing said holes and receiving the continuous said rope segments extending therethrough and being slidably engaged through the corresponding holes whereby said restraining sleeve is automatically tightened over the forearm, and whereby the affected arm of a user may be passively raised and lowered through a range of motion by pulling on said hand grasping member with the unaffected arm.

2. A self-assisted shoulder passive range of motion apparatus as set forth in claim 1, further comprising:

a forearm strap releasably attachable over the forearm to said forearm support for restraining the forearm from substantial movement with respect to said forearm support.

3. A self-assisted shoulder passive range of motion apparatus as set forth in claim 1, further comprising:

a compressible resilient layer attached to and substantially covering a concave surface of said forearm support for forearm comfort.

4. A self-assisted shoulder passive range of motion apparatus as set forth in claim 1, wherein:

a wrist-supporting portion of said forearm support is resiliently downwardly flexible for enhanced wrist comfort during range of motion movement of the affected arm.

5. A self-assisted shoulder passive range of motion apparatus as set forth in claim 1, wherein:

said forearm support includes upwardly extending tabs positioned on either side of the forearm for lateral forearm stabilization.

6. A self-assisted shoulder passive range of motion apparatus as set forth in claim 1, further comprising:

elongated rope spacers releasably attachable between, and maintaining spaced alignment of, two adjacent said rope segments.

7. A self-assisted shoulder passive range of motion apparatus as set forth in claim 1, wherein:

movement of said forearm support by pulling said hand grasping member causes passive movement of the gleno-humeral joint through the planes of motion including the shoulder flexion, scaption and abduction of the affected shoulder.

8. A self-assisted shoulder passive range of motion apparatus comprising:

an elongated concave contoured forearm support adapted to receive the forearm of the affected arm and extending generally between the elbow and wrist of the user;

a double pulley assembly having two closely spaced coaxially mounted secondary pulleys and an attaching hook or ring;

a single pulley connectable for support to an upper door edge;

a main support rope, one end of which is attached to the attaching hook or ring of said double pulley, the other end of said main support rope having a hand grasping member, a central portion of said main support rope engagable over said single pulley for free rolling movement thereover;

a secondary rope attached at one end thereof to a first hole of a plurality of holes formed through said forearm support adjacent to a side margin of an elbow end of said forearm support;

a central portion of said secondary rope extending from said first hole, then passing over one of said secondary pulleys, then extending to a second hole of said plurality of holes, said second hole positioned adjacent to a side margin of a wrist end of said forearm support, said secondary rope then extending over the wrist to a third hole of said plurality of holes opposing said second hole, then extending to and passing over the other said secondary pulleys and then attaching at another end of said secondary rope at a fourth hole of said plurality of holes, said fourth hole opposing said first hole;

whereby movement of said forearm support by pulling said hand grasping member with the unaffected arm causes passive movement of the gleno-humeral joint through the planes of motion including the shoulder flexion, scaption and abduction of the affected shoulder.

9. A self-assisted shoulder passive range of motion apparatus as set forth in claim 8, further comprising:

a forearm strap releasably attachable over the forearm to said forearm support for restraining the forearm from substantial movement with respect to said forearm support.

10. A self-assisted shoulder passive range of motion apparatus as set forth in claim 9, further comprising:

a restraining sleeve positioned transversely between said two opposing second and third holes and receiving extending therethrough and being slidably engaged through the corresponding holes whereby said restraining sleeve is automatically tightened over the forearm.

11. A self-assisted shoulder passive range of motion apparatus as set forth in claim 10, further comprising:

a compressible resilient layer attached to and substantially covering a concave surface of said forearm support for forearm comfort.

12. A self-assisted shoulder passive range of motion apparatus as set forth in claim 11, wherein:

a wrist-supporting portion of said forearm support is resiliently downwardly flexible for enhanced wrist comfort during range of motion movement of the affected arm.

13. A self-assisted shoulder passive range of motion apparatus as set forth in claim 12, wherein:

said forearm support includes upwardly extending tabs positioned on either side of the forearm for lateral forearm stabilization.

14. A self-assisted shoulder passive range of motion apparatus as set forth in claim 13, further comprising:

elongated rope spacers releasably attachable between, and maintaining spaced alignment between, two adjacent secondary rope segments.

* * * * *

UNITED STATES PATENT AND TRADEMARK OFFICE

CERTIFICATE OF CORRECTION

PATENT NO. : 7,364,555 B1
APPLICATION NO. : 11/141821
DATED : April 29, 2008
INVENTOR(S) : John Davidson It is certified that error appears in the above-identified patent and that said Letters Patent is hereby corrected as shown below:

Column 8, line 21 after "receiving" insert --secondary rope--.

Signed and Sealed this

Eighteenth Day of August, 2009

David J. Kappos

David J. Kappos
*Director of the United States Patent and Trademark Office*